United States Patent [19]

Feder

[11] 4,114,000

[45] Sep. 12, 1978

[54] MULTI-POSITION SWITCH WITH SINGLE SLIDING ACTUATOR CAM, RECIPROCABLE CAM FOLLOWER AND COMPRESSIVE CONDUCTIVE ELASTOMER

[75] Inventor: Alvin Feder, Lauderhill, Fla.

[73] Assignee: Motorola, Inc., Schaumburg, Ill.

[21] Appl. No.: 800,245

[22] Filed: May 25, 1977

Related U.S. Application Data

[63] Continuation of Ser. No. 554,860, Mar. 3, 1975, abandoned.

[51] Int. Cl.[2] ..... H01H 15/02; H01H 1/02

[52] U.S. Cl. ..... 200/16 R; 200/153 LA; 200/159 R; 200/264; 200/16 D

[58] Field of Search ..... 200/5 R, 5 A, 16 R, 200/16 A, 16 C, 16 D, 46, 159 R, 159 A, 159 B, 86 R, 243, 248–250, 264, 265, 153 L, 153 LA; 338/99, 100, 114, 118

[56] References Cited

U.S. PATENT DOCUMENTS

| | | | |
|---|---|---|---|
| 3,509,296 | 4/1970 | Harshman et al. | 200/159 R |
| 3,699,294 | 10/1972 | Suddoth | 200/264 X |
| 3,800,105 | 3/1974 | Thornley | 200/264 X |
| 3,800,112 | 3/1974 | DuRocher | 200/264 X |
| 3,806,685 | 4/1974 | Seeger, Jr. et al. | 200/153 LA |
| 3,819,895 | 6/1974 | Pittman et al. | 200/264 X |
| 3,873,795 | 3/1975 | Leighton et al. | 200/264 X |
| 3,879,586 | 4/1975 | DuRocher et al. | 200/264 X |
| 3,918,020 | 11/1975 | DuRocher et al. | 200/264 X |
| 3,952,173 | 4/1976 | Tsuji et al. | 200/264 |
| 3,979,570 | 9/1976 | Hyodo | 200/264 |
| 3,983,355 | 9/1976 | Hyodo | 200/264 |
| 3,988,556 | 10/1976 | Hyodo | 200/264 |

FOREIGN PATENT DOCUMENTS

| | | | |
|---|---|---|---|
| 2,507,477 | 8/1976 | Fed. Rep. of Germany | 200/159 R |

*Primary Examiner*—James R. Scott

*Attorney, Agent, or Firm*—James W. Gillman; Victor Myer; Phillip H. Melamed

[57] ABSTRACT

A three position switch which selectively interconnects isolated conductors on a printed circuit board is disclosed. In one embodiment, pressure sensitive conductive elastomer pads, disposed in the switch, are brought into contact with isolated conductors on a substrate. A sliding switch actuator, having a cam surface with indentations, is then used to selectively apply pressure to the conductive elastomer pads and thereby selectively connect the isolated printed circuit board conductors. In another embodiment, a three position switch is shown including a plurality of conductive pads, flexibly attached to a switch casing, which are positioned above printed circuit board isolated conductors and then selectively flexed downward into contact with the printed circuit board conductors by moving a sliding actuator arm having a cam surface. The conductive pads are normally separated from the printed circuit board conductors by a flexible rubber shoulder which forms a seal around the contact area and is flexed outward while maintaining the seal when the conductive pads are flexed into contact with the printed circuit board conductors.

21 Claims, 11 Drawing Figures

Fig. 1
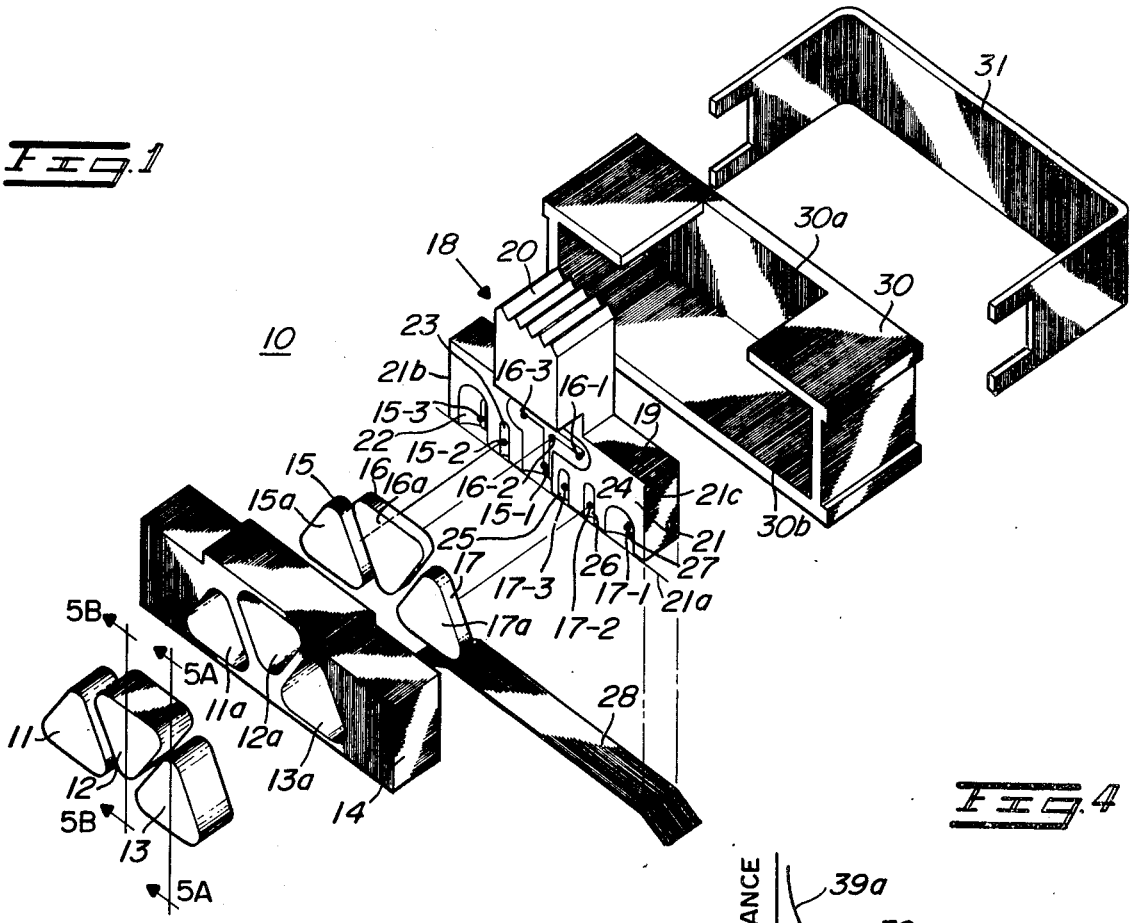
Fig. 4
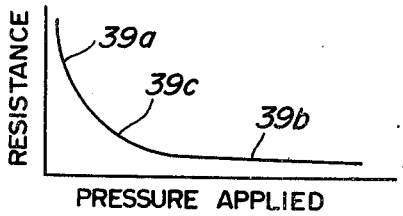
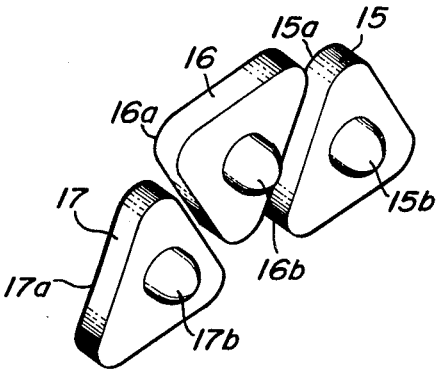
Fig. 2
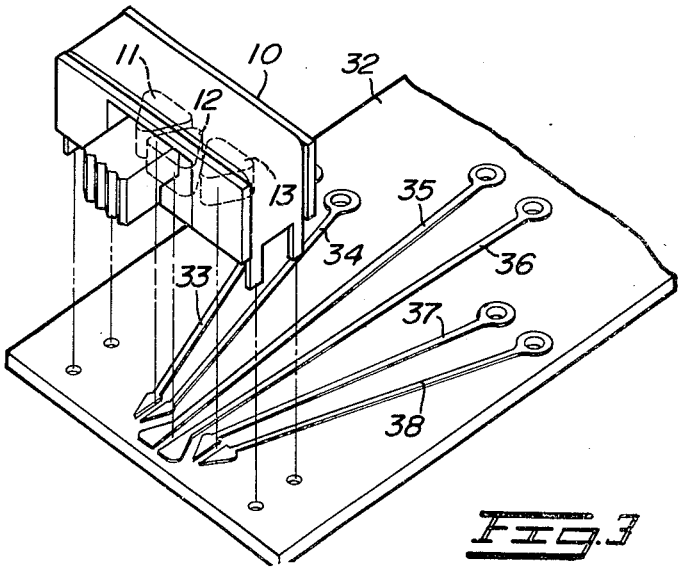
Fig. 3

Fig. 6
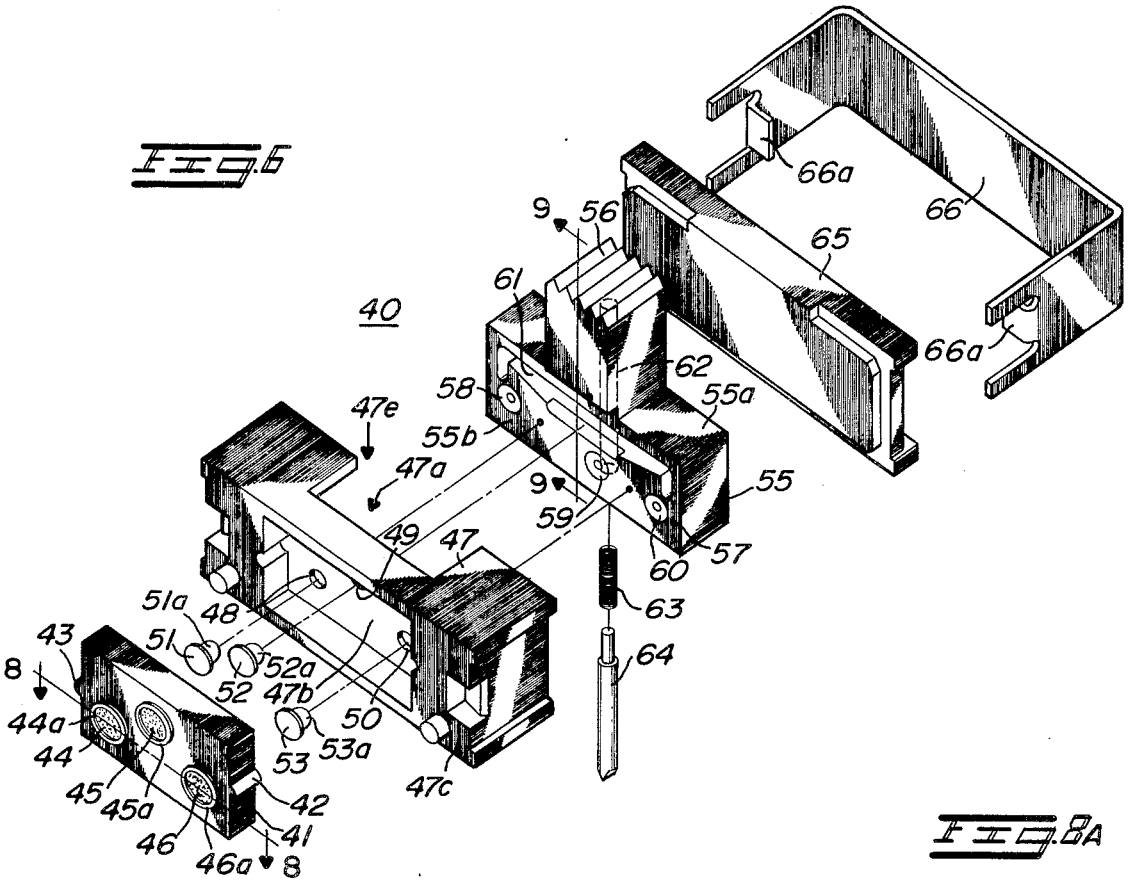
Fig. 8A
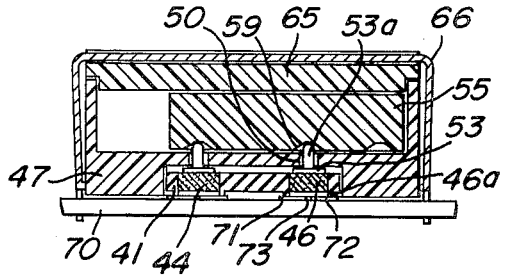
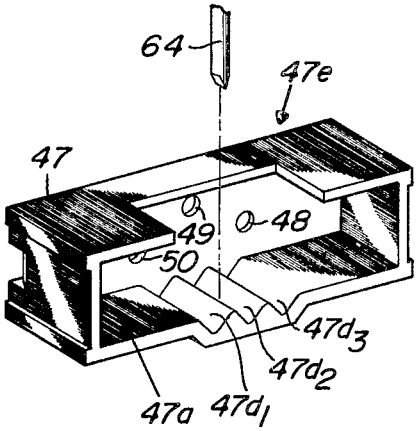
Fig. 7
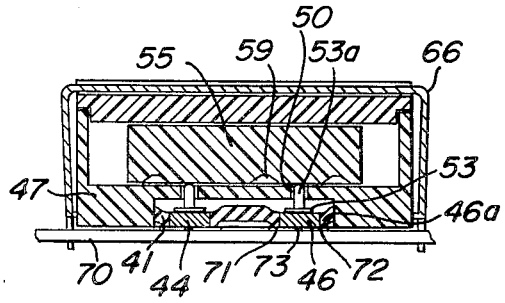
Fig. 8B

MULTI-POSITION SWITCH WITH SINGLE SLIDING ACTUATOR CAM, RECIPROCABLE CAM FOLLOWER AND COMPRESSIVE CONDUCTIVE ELASTOMER

This is a continuation of application Ser. No. 554,860, filed now abandoned.

BACKGROUND OF THE INVENTION

This invention generally relates to the field of multiple position switches for interconnecting isolated conductors. In particular it relates to the use of leadless multiple position switches for selectively connecting isolated conductors and the use of pressure sensitive and conductive elastomer pads in such switches.

Generally, multiple position switches make contact to a printed circuit board by using external leads and these external leads are selectively shorted out by a rigid conductive contact arm being moved into electrical contact across the leads. The moving contact arm creates wear on the contacted points of the leads and the switch is susceptible to dust and moisture conditions which can impair the electrical connection between the moving metal contact arm and the leads.

Switches using conductive elastomer materials and pressure sensitive conductive elastomer materials are known in the art, but have generally required a separate actuator arm for each conducting state that is desired. Also, the prior art pressure sensitive conductive elastomer switches normally force electric current in the same direction as the pressure being applied, and therefore do not use the transverse electrical conductivity of the pressure sensitive conductive elastomer pad.

SUMMARY OF THE INVENTION

An object of the present invention is to provide an improved multiple position switch having a single actuator arm.

Another object of the invention is to provide a leadless multiple position switch for use with externally located conductor pads.

Still another object of the invention is to provide an improved multiple position switch which environmentally seals the conductor areas to be contacted.

In one embodiment of the invention there is provided a multiple position switch for selectively interconnecting a plurality of isolated conductors, which includes: a casing; positioning means attached to said casing for positioning components with respect thereto; a plurality of conductive means flexibly joined to said casing and located in relatively fixed predetermined positions with respect thereto by said positioning means, and positioned normally adjacent to said plurality of isolated conductors for conductively contacting and electrically bridging a pair of said conductors when each of said conductive means is flexed in a predetermined direction; and actuator means, mechanically coupled to said casing and movable into a plurality of predetermined positions with respect thereto, including a cam surface selectively coupled to said plurality of conductive means for selectively flexing a predetermined number of said conductive means in said direction when said actuator means is in each of said pluraity of predetermined positions.

Therefore a single actuator arm is provided with a cam surface that selectively compresses a number of spatially separated conductor means which are positioned such that the cam surface selectively pushes against the conductor means forcing them into electrically conductive contact with isolated conductors. When pressure sensitive elastomer pads are the conductor means and are initially contacting the isolated conductors, the cam surface movement merely creates pressure to compress the pads and render them conductive, and the contact areas of the isolated conductors are sealed off from environmental influences. Thus dust and corrosion effects on the contacted sections of the isolated conductors are minimized. When the conductive means consists of conductive pads flexibly mounted to the switch casing and positioned away from the contact areas of the isolated conductors, a flexible shoulder is provided to environmentally seal the contact areas and the cam surface movement now pushes the conductive pads into contact with the isolated conductor contact areas while maintaining the environmental seal around the contact areas.

BRIEF DESCRIPTION OF THE DRAWINGS

For a more complete understanding of the invention reference should be made to the drawings, in which:

FIG. 1 is an exploded perspective view of a three position switch, having a momentary contact feature, which is constructed according to the invention;

FIG. 2 is a detailed enlarged perspective view of the cam followers shown in FIG. 1;

FIG. 3 is an assembly view of the switch shown in FIG. 1 about to be mounted onto a printed circuit board having a plurality of isolated conductors;

FIG. 4 is a graph showing a typical resistance versus pressure characteristic for the pressure sensitive conductive elastomer pads used in the switch shown in FIG. 1;

FIG. 6 is an exploded perspective view of another three position momentary contact switch constructed according to the invention;

FIG. 7 is a detailed perspective view of the interior cavity of the casing member shown in FIG. 6;

FIG. 8A is a cross-sectional view of the switch shown in FIG. 6 taken along lines 8—8 and illustrating one operative position the switch;

FIG. 8B is a cross-section view similar to view 8A illustrating another operative position.

DETAILED DESCRIPTION OF THE PREFERRED EMBODIMENTS OF THE INVENTION

Figure 5A:
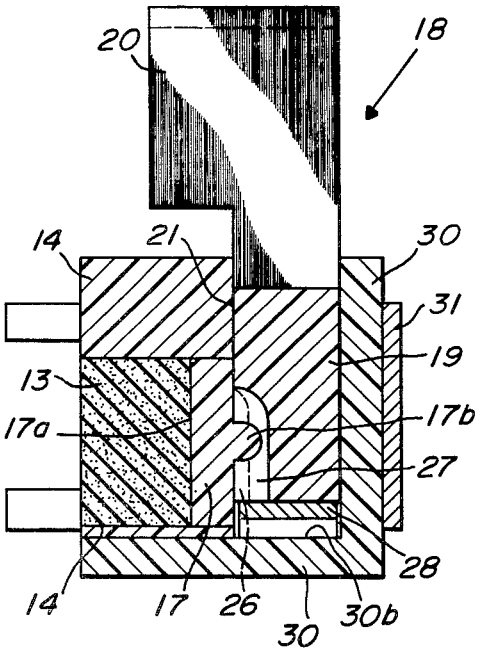
FIG. 5A is an enlarged cross-sectional view of the assembled switch shown in FIG. 1 taken along lines 5A—5A.

Referring to FIG. 1, a three position switch 10 is shown in an exploded view in its middle operative position. A series of three solid triangular shaped pressure sensitive conductive elastomer pads 11, 12 and 13 are shown and are to be located in a series of corresponding openings 11*a*, 12*a* and 13*a* in a generally rectangular switch case positioning member 14. A series of three triangular shaped cam follower members 15, 16 and 17 are shown also to be mounted in openings 11*a* and 12*a* 13*a* respectively, with a flat side (15*a*, 16*a*, and 17*a*) for resting against the corresponding conductive elastomer pad and a rounded end projection (15*b*, 16*b* and 17*b*, shown in FIG. 2) centrally located on a surface parallel to the flat side and extending away from the conductive elastomer pad.

An actuator arm generally referred to as 18 is shown having a solid rectangular body 19 with a centrally located rectangular projection 20 extending therefrom and a generally rectangular cam surface 21 comprising a surface of body 19. Cam surface 21 includes a series of indentations (grooves), all terminating at a common lengthwise edge 21*a* of surface 21, comprising: a deep straight groove 22 which is perpendicular to edge 21*a* and located near an end 21*b* of cam surface 21, a shallow groove 23 which is parallel and adjacent to groove 22 and closer to an opposite end 21*c* of cam surface 21, a deep T-shaped groove 24 having a lower arm adjacent and paralel to groove 23 ad an upper arm parallel to edge 21*a*, a shallow groove 25, a shallow groove 26 and a deep groove 27, all of which are progressively located from groove 24 of the cam surface 21 to end 21*c* respectively. Grooves 22, 23, 25, 26, and 27 are each mutually parallel and each extends about half way across cam surface 21.

A spring 28 consists of a flat metal ribbon lead having each of its ends bent so as to generally form a U-shape. Spring 28 is shown as having the base of the U-shape located so as to engage the bottom surface of actuator means 18, which includes edge 21*a*.

An external casing 30, which is shown as comprising five external walls arranged to form a rectangular cavity, forms part of the external housing of switch 10. A rectangular clearance notch 30*a*, for actuator projection 20, is shown in one of the walls of external casing 30 which is located parallel to a bottom surface 30*b*. A metal U-shaped mounting clip 31 is shown positioned for wrapping around external casing 30 and is used for mounting switch 10 onto a circuit board.

When switch 10 is assembled, conductive elastomer pads 11, 12, and 13 are mounted in openings 11*a*, 12*a*, and 13*a* respectively and cam follower means 15, 16, and 17 are likewise mounted in openings 11*a*, 12*a*, and 13*a*, the respective projections 15*b*, 16*b*, and 17*b* facing outwardly. The conductive elastomer pads are flexible and are flexibly joined to the casing of switch 10 by press fitting them into positioning member 14. The U-shaped spring 28 is mounted inside casing 30 with the arms of the U-spring pushing against bottom surface 30*b* of casing 30. Actuator means 18 is then mounted on top of U-spring 28 with projection 20 extending through the clearance opening 30*a* of casing 30. Then positioning member 14, which now includes conductive pads 11, 12 and 13 and cam follower means 15, 16 and 17, is pushed into casing 30 such that the cam follower projections 15*b*, 16*b* and 17*b* are facing cam surface 21. Clip 31 is then wrapped around the exterior of casing 30.

In FIG. 3, the assembled switch 10 is shown ready to be mounted onto a printed circuit board 32 having three pairs of conductor metalizations 33–34, 35–36, and 37–38, which are to be located adjacent to and in contact with elastomer pads 11, 12 and 13, respectively (shown in phantom). The conductor metalizations present on printed circuit board 32 are shown as being electrically and spatially isolated and switch 10 will selectively interconnect the conductors located on circuit board 32 by electrically bridging the conductors with resistances in a manner as will now be described.

Referring to FIG. 4, a graph of resistance versus pressure applied for the pressure sensitive elastomer material used for pads 11, 12 and 13 is shown. The graph shows that when a large force is applied to the pressure sensitive material, the resistance of the material is drastically decreased.

The resistance versus pressure characteristic shown in FIG. 4 is merely an example of a typical pressure sensitive conductor elastomer characteristic. The graph has a generally hyperbolic shape which has a high resistance and rapidly changing section 39*a* (at low values of pressure applied), a low resistance and slowly changing section 39*b* (at high values of pressure applied), and a transition section 39*c* connecting sections 39*a* and 39*b*.

When switch 10 is mounted to circuit board 32 and actuator arm 18 is in a first position, the projection 15*b* of cam follower 15 rests in the lower arm of deep indentation 24 (shown in FIG. 1 as point 15-1 on cam surface 21), the cam follower projection 16*b* rests in the upper arm section of T-shaped groove 24 (shown in FIG. 1 as point 16-1), and the projection 17*b* rests in deep indentation 27 (shown as point 17-1). In this first position, actuator 18 provides no force against cam followers 15, 16, and 17, and therefore no significant pressure is applied to compress (flex) the conductive elastomer pads 11, 12 and 13. Consequently, the conductor pairs on printed circuit board 32 remain isolated.

FIG. 5A shows a cross-section view of switch 10 in its first position (all corresponding parts are identically numbered) and illustrates that because projection 17*b* rests in deep indentation 27, no pressure is applied to pressure sensitive pad 13.

Figure 5B:
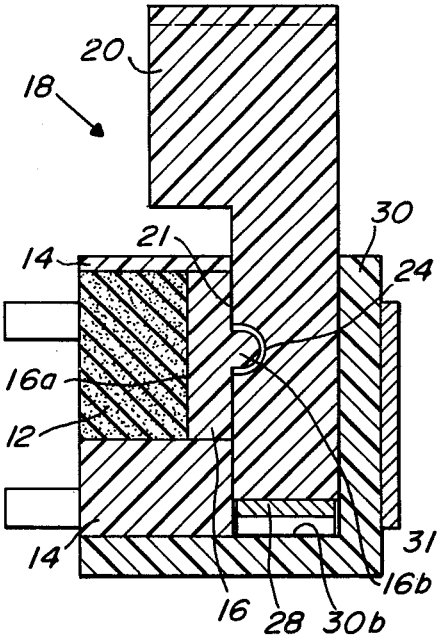
FIG. 5B is an enlarged cross-sectional view of the assembled switch shown in FIG. 1 taken along lines 5B—5B.

FIG. 5B shows a similar cross-sectional view of switch 10 illustrating that projection 16*b* rests in deep indentation 24 when switch 10 is in its first position. If actuator arm 18 is pushed against spring 28, by applying pressure to actuator peojection 20 in a direction perpendicular to surface 30*b*, cam surface 21 will shift downward with respect to positioning member 14 and the attached cam followers, resulting in cam follower 16 being forced against pad 12 by cam surface 21 while the projections 15*b* and 17*b* remain in deep grooves 24 and 27, respectively. Therefore actuator arm 18 applies pressure to flex (compress) pad 12 and this results in a low resistance being connected across conductors 35 and 36 in FIG. 3. By pushing actuator arm 18 against spring 28, a momentary resistance connection is implemented.

When actuator arm 18 is slid into a second (middle) position, the projection 15*b* rests in shallow indentation 23 (shown as point 15-2 in FIG. 1), the projection 16*b* agan rests in the upper deep arm section of indentation 24 but at a slightly shifted position (shown as point 16-2), and the projection 17*b* rests in shallow indentation 26 (shown as point 17-2). When switch 10 is in this second position, cam surface 21 (which includes the indentations) exerts a significant pressure against cam followers 15 and 17 which is sufficient to flex and render pads 11 and 13 conductive respectively, while pad 12 is in a non-conductive state since projection 11*b* rests in a deep indentation. FIG. 5A shows (in dashed lines) the outline of shallow indentation 26 which causes cam follower 17 to compress pad 13 when switch 10 is in its second position. When switch 10 is mounted on printed circuit board 32 and is in its second position, conductor pairs 33–34 and 37–38 have a low value of resistance applied between them. If actuator 18 is forced against spring 28 while the actuator is in its second position, the result is that cam follower 16 will be forced against pad 12 by cam surface 21 resulting in a low value of resistance also being connected across conductors 35 and 36.

When actuator arm 18 is slid into a third position the projection 15*b* rests in deep indentation 22 (shown as point 15-3 in FIG. 1), the projection 16*b* still rests in the upper arm section of deep indentation 24 (shown as point 16-3), and the projection 17*b* rests in shallow indentation 25 (shown as point 17-3). Thus when switch 10 is in its third position and mounted on printed circuit board 32 in FIG. 3, pads 11 and 12 are not compressed but pad 13 is rendered conductive by the pressure exerted by cam follower 17 being displaced by shallow indentation 25 of cam surface 21. A low resistance is therefore connected between conductor pair 37–38. If actuator means 18 is pressed against spring 28 while switch 10 is in its third position, an additional low resistance will be connected across conductor pair 35–36 since the projection 16*b* of cam follower 16 will be forced against a non-indented portion of cam surface 21.

A three position slide switch which also has a momentary on position has been disclosed. When actuator arm 18 is slid into each of several distinct predetermined positions, isolated conductor metalizations are selectively interconnected by resistances being applied between them because actuator arm 18 selectively flexes and renders conductive pads 11, 12, and 13. The cam surface indentations and the cam follower projections provide switch 10 with three discrete stable positions for actuator arm 18 relative to positioning member 14. Switch 10 has several discrete modes of connection in addition to a momentary on mode of operation. Therefore a leadless multi-position switch which is used in conjunction with a printed circuit board has been described. The invention is not limited to a leadless switch since the metalized conductor board may be combined to form part of the inventive switch and leads may then be attached to each of the isolated conductor metalizations. While the pressure sensitive pads are preferably always contacting the isolated conductors and therefore creating an environmental seal for the contacted areas thereof, the inventive switch is not limited to having the pads in contact with the conductors when no pressure is applied by the cam followers. To increase the effective conductivity of the elastomer pads when pressure is applied to them, a solid conductor may be placed on surfaces 15*a*, 16*a* and 17*a*, so that more than just the transverse conductivity of the elastomer pads can be used.

If switch 10 is used as an on-off switch, it is obvious that a short transition section and a rapidly changing (as a function of pressure) initial section would be desirable as the electrical characteristic of the elastomer pad material. so that an infinitely high resistance would be present when no pressure is applied and zero resistance present when any significant pressure is applied. By designing a more intricate cam surface configuration and using elastomer materials having a gradual and linear resistance versus pressure characteristic, a switch can be designed with any number of discrete positions for implementing a number of discrete resistance values which are selectively interconnected between isolated conductors. The use of a single sliding actuator means for selectively connecting resistance values between a number of isolated conductors has therefore been illustrated.

Pressure sensitive conductive elastomer materials, having characteristics similar to the characteristic shown in FIG. 4, are commonly available. In the preferred embodiment shown in FIG. 1, material sold under the name (TM) Pressex, made by Essex International, Inc., was used and satisfactory results were obtained. Such material may consist of metal particles in a suitable elastomer binder.

In FIG. 6 aother embodiment of a multiple position switch 40 is shown in an exploded assembly view. In this version, conductive pads are flexibly joined to the switch casing and are selectively actuated by a single sliding actuator arm. A rectangular flexible rubber pad 41, having end mounting tabs 42 and 43, is shown with three circular openings each of which contains a conductor pad 44, 45, and 46. Each opening is surrounded, on one side of the rubber pad 41, by flexible rubber shoulder rings 44*a*, 45*a*, and 46*a*, respectively. Conductor pads 44, 45, and 46 are preferably metal particle filled conductive elastomer pads which are bonded to rubber pad 41, but any type of conductor pads can be used, including pressure sensitive conductor pads. A casing member 47 is generally rectangular in shape having five exterior walls defining a cavity 47*a* (shown in detail in FIG. 7). Casig 47 has a recessed area 47*b*, in the exterior of a wall 47*c*, which corresponds to the general shape of rubber pad 41 and includes a group of three holes 48, 49, 50. The holes are located such that when rubber pad 41 is mounted into recess 47*b*, conductor pads 44, 45 and 46 will be aligned with openings 48, 49 and 50 respectively.

A series of three identical cam followers 51, 52, and 53, each consisting of a disc and a corresponding central projection (designated by 51*a*, 52*a*, and 53*a*, respectively), are illustrated in FIG. 6. Openings 48, 49, and 50 in casing member 47 are smaller than the disc diameter of components 51, 52 and 53 but larger than their corresponding projections. A sliding generally rectangular shaped actuator 55 has a rectangular projection 56 extending outwardly from a surface 55*a*. A cam surface 57 of actuator 55 includes a series of three circular indentations 58, 59, and 60 and a long slot 61 which is parallel to surface 55*a*, extends through actuator 55, and partitions actuator 55 into an upper section including surface 55*a*, and a lower section designated as 55*b* which can be flexed together by compression since actuator 55 is made from a slightly flexible material (preferably plastic). A circular hole 62 (shown dotted) extends through the rectangular body of actuator 55 and into projection 56. A spring 63 is positioned for resting on the shoulder of a pin 64 which is to be inserted into hole 62. A rectangular case cover 65 is shaped so as to enclose actuator 55 within the cavity 47*a* formed by the walls of case member 47. A clip 66 has a general U-shape with inwardly facing end projections 66*a* for clamping together members 47, 55, and 65.

FIG. 7, details casing member 47 including the interior cavity 47*a* into which the actuator 55 will be positioned. The bottom surface of the interior cavity 47*a* has a series of three grooves $47d_1$, $47d_2$, and $47d_3$, which form barriers for pin 64 when it is inserted into actuator 55 and actuator 55 is in cavity 47*a*. Grooves 47*d*, pin 64, and spring 63 determine three set positions of actuator 55 and therefore three predetemined set positions of switch 40. A notch 47*e* is in a top surface wall of cavity 47*a* through which actuator projection 56 will extend when the switch 40 is assembled.

Referring to FIG. 8A, the assembled switch 40 is shown, in a first operative position, mounted to a printed circuit board 70 having top conductor metalization layers (conductors) 71 and 72 which have a gap 73 between them. The circular rubber shoulder 46*a* of rubber pad 41 is disposed in contact with metalizations 71 and 72, and conductor pad 46 is positioned above gap 73 and not contacting the printed circuit board conductors. The disc part of cam follower 53 is positioned between rubber pad 41 and casing member 47 with projection 53*a* extending through opening 50. Actuator arm 55 is positioned relative to casing member 47 such that projection 53*a* rests in indentation 59 of actuator 55. The conductors 71 and 72 are isolated from each other since conductor pad 46 does not contact them and form an electrical connection.

Referring to FIG. 8B, actuator arm 55 has been shifted to a second (middle) operative position relative to the casing member 47 so that projection 53*a* rests against an exterior non-indented portion of cam surface 57. Consequently the cam follower 53 is forced downwardly causing the rubber shoulder 46*a* to buckle outwardly permitting conductor pad 46 to make contact between the conductor metalizations 71 and 72.

Rubber pad 41, located in recess 47*b*, is held in position by the end mounting tabs 42 and 43 and also by the friction between its outside edges and the side walls of recess 47*b*. When the actuator arm 55 moved, switch 40 selectively interconnected the conductor metalizations 71 and 72. Since the rubber shoulder ring 46*a* is always in contact with conductor metalizations 71 and 72, the rubber shoulder ring forms an environmental seal around the portions of conductor metalizations 71 and 72 that are to be bridged. Thus a leadless slide switch having a single actuator arm and which forms an environment seal around contacting areas has been illustrated by switch 40.

The switch 40 is assembled by first inserting spring 63 and pin 64 into opening 62 in actuator 55. Then the actuator assembly is pushed into casing 47 with pin 64 resting in one of the grooves (47*d*) of casing 47 and actuator projection 56 extending outwardly through notch 47*e*. Cam followers 51, 52 and 53 have their corresponding projections 51*a*, 52*a* and 53*a* inserted into holes 48, 49 and 50 respectively. Rubber pad 41 is then press fit inserted into recess 47*b* with the locations of conductor pads 44, 45 and 46 corresponding to the locations of cam followers 51, 52 and 53 respectively, and with rubber shoulders 44*a*, 45*a*, and 46*a* facing away from case 47. Thus rubber pad 41 flexibly joins conductor pads 44, 45, and 46 to the case of switch 40. The cover 64 is pressed into place enclosing the body of actuator 55 within the inside cavity 47*a* of casing 47, with the exception of extension 56. The clip 66 is snapped into place around casing 47 and cover 65, and holds switch 40 together by means of the inwardly facing projections 66*a* gripping the ends of casing wall 47*c*.

When actuator 55 is in its first operative position: the pin 64 is engaged in groove $47d_1$, projection 51*a* rests in indentation 58, projection 53*a* rests in indentation 59, and projection 52*a* rests in slot 61. Switch 40, in its first position, exerts no downward outward pressure on conductors 44, 45, or 46, as shown in FIG. 8A. Conductor 45 can be momentarily forced downwardly by an inward pushing on extending actuator projection 56 as will be explained in detail later on.

When actuator 55 is in its second (middle) position: the pin 64 rests in groove $47d_2$, the projection 53*a* rests against the exterior of cam surface 57 in between indentations 59 and 60, projection 51*a* rests against the exterior of surface 57 in between indentations 58 and 59, and projection 52*a* rests in slot 61. Thus when actuator 55 is in the second position, switch 40 has conductors 44 and 46 forced in an outward direction, as shown in FIG. 8*b*. The momentary actuation of conductor 45 is accomplished by pushing extending projection 56 inward in the same manner as will be described.

When the actuator 55 is in a third operative position with respect to case 47: the pin 64 rests in groove $47d_3$, the projection 53*a* rests in indentation 60, the projection 51*a* rests on cam surface 57 between indentations 58 and 59, and projection 52*a* rests in notch 61. If switch 40, with actuator 55 in its third position, is mounted against a printed circuit board having isolated conductors (similar to the mounting of switch 10 as shown in FIG. 3), conductor pad 44 would be forced into contact with the printed circuit board metallizations and conductor pads 45 and 46 would not contact or bridge any printed circuit board conductors.

Figure 9:
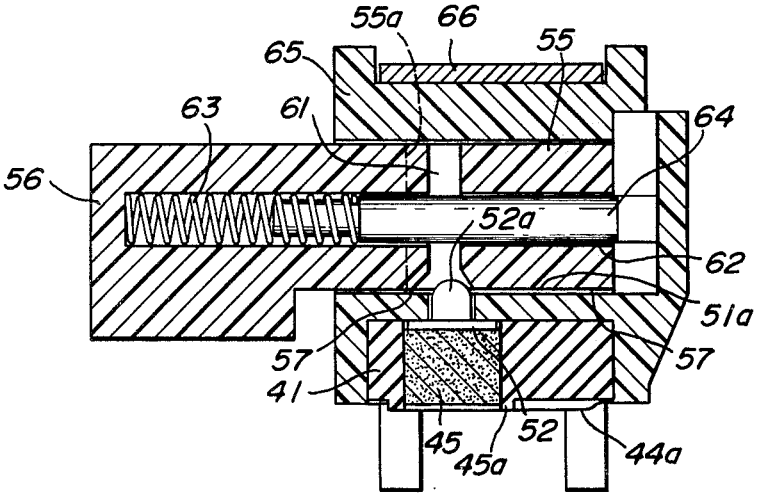
FIG. 9 is a cross-section view of the switch shown in FIG. 6 taken along lines 9—9.

Referring to FIG. 9, if extending projection 56 was then depressed while actuator arm 55 is in its third position, the upper section (including surface 55*a*) of actuator 55 would flex and partially close slot 61, which would bring a portion of cam surface 57 into contact with cam projection 52*a*, forcing conductor 45 in a downward direction. A momentary contact actuation similar to the momentary actuation of switch 10 has therefore been implemented. FIG. 9 clearly illustrates how the closing of gap 61 will force conductor pad 45 in a downward direction when actuator 55 is in either its first, second, or third position.

Thus FIGS. 1 and 6 illustrate similar variable position switches for selectively interconnecting a plurality of isolated conductors and include conductive and pressure sensitive conductive pads which are flexibly joined to the casing and actuated by a single sliding actuator. Although both switches are illustrated as leadless multiple position switches that are used in conjunction with printed circuit board conductors, in both cases the circuit board conductors can be incorporated into the switch and a leaded switch developed.

While I have shown and described specific embodiments of this invention, further modifications and improvements will occur to those skilled in the art. All such modifications which retain the basic underlying principles disclosed and claimed herein are within the scope of this invention.

I claim:

1. A multiple position switch for selectively interconnecting a plurality of isolated conductors, including:

a casing;

positioning means attached to said casing for positioning components with respect thereto;

a plurality of conductive means flexibly joined to said casing and located in relatively fixed predetermined positions with respect thereto by said positioning means;

mounting means coupled to said casing for positioning each of said conductive means normally adjacent to a plurality of isolated conductors for conductively contacting and electrically bridging a pair of said conductors in response to each of said conductive means being flexed in a predetermined direction; and actuator means mechanically contacting said casing and slideably movable in first and second linear orthogonal directions into a plurality of at least three predetermined positions with respect thereto, said actuator means including a cam surface selectively coupled to said plurality of conductive means for selectively flexing a predetermined number of said conductive means in said predetermined direction in response to said actuator means being in each of said plurality of predetermined positions.

2. The multiple position switch according to claim 1 wherein said plurality of conductive means are joined to said casing by said positioning means such that a surface of each of a number of said plurality of conductive means is exposed as part of the exterior of said switch.

3. The multiple position switch according to claim 2 which includes a flexible rubber shoulder that surrounds each of said exposed conductive means exterior surfaces and prevents said surfaces from contacting said plurality of conductors until said conductive means is flexed.

4. A multiple position switch for selectively interconnecting a plurality of isolated conductors, including:

an external casing including positioning means for positioning components with respect thereto;

a plurality of pressure sensitive conductive elastomer pads joined to said casing and located in predetermined positions with respect thereto by said positioning means;

mounting means coupled to said casing for positioning each of said pads normally adjacent to a plurality of isolated conductors for conductively contacting and electrically bridging a pair of said conductors in response to each of said elastomer pads being compressed in a predetermined direction; and actuator means mechanically contacting said casing and slideably movable in first and second linear orthogonal directions into a plurality of at least three predetermined positions with respect thereto, said actuator means including a cam surface selectively coupled to said plurality of elastomer pads for selectively compressing a predetermined number of said conductive means in said predetermined direction in response to said actuator means being in each of said plurality of predetermined positions.

5.The multiple position switch according to claim 4 wherein said plurality of pressure sensitive conductive elastomer pads have a resistivity versus pressure characteristic that includes a rapidly changing initial section.

6. The multiple position switch according to claim 4 wherein said external casing has a plurality of openings which expose a surface of each of a number of said plurality of conductive elastomer pads for positioning adjacent to said isolated electrical conductors.

7. The multiple position switch according to claim 6 which includes a holding clip for mounting said switch to a circuit board having a surface with a plurality of exposed electrical conductors thereon.

8. A multiple position switch for selective interconnecting a plurality of isolated conductors, including:

a casing;

positioning means attached to said casing for positioning components with respect thereto;

a plurality of conductive pads flexibly joined to said casing and located in relatively fixed predetermined positions with respect thereto by said positioning means;

mounting means coupled to said casing for positioning said conductive pads normally adjacent to a plurality of isolated conductors for conductively contacting and electrically bridging a pair of said conductors in response to each of said conductive means being flexed in a predetermined direction; and actuator means mechanically contacting said casing and slideably movalbe in first and second linear orthogonal directions into a plurality of at least three predetermined positions with respect thereto, said actuator means including a cam surface selectively coupled to said plurality of conductive means for selectively flexing a predetermined number of said conductive means in said predetermined direction in response to said actuator means being in each of said plurality of predetermined positions.

9. The multiple position switch according to claim 8 wherein said plurality of conductive pads are conductive elastomer pads.

10. The multiple position switch according to claim 8 wherein said plurality of pads are coupled to said casing such that a surface of each of a number of said plurality of conductive elastomer pads is part of the exterior of said switch.

11. The multiple position switch according to claim 10 wherein each of said exterior pad surface is surrounded by a flexible rubber shoulder which prevents said surface from contacting said plurality of conductors until said pad is flexed.

12. A multiple position switch for selectively interconnecting a plurality of isolated conductors, including:

a casing;

positioning means attached to said casing for positioning components with respect thereto;

a plurality of conductive means flexibly joined to said casing and located in relatively fixed predetermined positions with respect thereto by said positioning means;

mounting means coupled to said casing for positioning each of said conductive means normally adjacent to a plurality of isolated conductors for conductively contacting and electrically bridging a pair of said conductors in response to each of said conductive means being flexed in a predetermined direction;

actuator means mechanically contacting said casing and slideably movable in first and second linear orthogonal directions into a plurality of at least three predetermined positions with respect thereto, said actuator means including a cam surface selectively coupled to said plurality of conductive means for selectively flexing a predetermined number of said conductive means in said predetermined direction in response to said actuator means being in each of said plurality of predetermined positions; and a plurality of cam following means each coupled between an associated one of said conductive means and said cam surface, and mounted relatively fixed in a first and second orthogonal direction with respect to said conductive means by said positioning means, said cam following means being selectively forced, by movement of said cam surface, against said associated conductive means in a third direction orthogonal to said first and second directions.

13. The multiple position switch according to claim 12 wherein said plurality of conductive means are joined to said casing by said positioning means such that a surface of each of a number of said plurality of conductive means is exposed as part of the exterior of said switch.

14. The multiple position switch according to claim 13 which includes a flexible rubber shoulder that surrounds each of said exposed conductive means exterior surfaces and prevents said surfaces from contacting said plurality of conductors until said conductive means is flexed.

15. A multiple position switch for selectively interconnecting a plurality of isolated conductors, including:

an external casing including positioning means for positioning components with respect thereto;

a plurality of pressure sensitive conductive elastomer pads joined to said casing and located in predetermined positions with respect thereto by said positioning means;

mounting means coupled to said casing for positioning each of said pads normally adjacent to a plurality of isolated conductors for conductively contacting and electrically bridging a pair of said conductors in response to each of said elastomer pads being compressed in a predetermined direction;

actuator means mechanically contacting said casing and slideably movable in first and second linear orthogonal directions into a plurality of at least three predetermined positions with respect thereto, said actuator means including a cam surface selectively coupled to said plurality of elastomer pads for selectively compressing a predetermined number of said conductive means in said predetermined direction in response to said actuator means being in each of said plurality of predetermined positions; and a plurality of cam following means each coupled between an associated one of said elastomer pads and said cam surface, and mounted relatively fixed in a first and second orthogonal direction with respect to said pads by said positioning means, said cam following means being selectively forced, by movement of said cam surface, against said associated pads in a third direction orthogonal to said first and second directions for applying pressure to compress said pads.

16. The multiple position switch according to claim 15 wherein said cam surface has indentations and said plurality of cam following means have projections which are in contact with said cam surface for providing said plurality of predetermined positions for said actuator means.

17. The multiple position switch according to claim 16 wherein said plurality of conductive elastomer pads consists of three pads and said plurality of cam following means consists of three cam following means.

18. A multiple position switch for selectively interconnecting a plurality of isolated conductors, including:

a casing;

positioning means attached to said casing for positioning components with respect thereto;

a plurality of conductive pads flexibly joined to said casing and located in relatively fixed predetermined positions with respect thereto by said positioning means;

mounting means coupled to said casing for positioning said conductive pads normally adjacent to a plurality of isolated conductors for conductively contacting and electrically bridging a pair of said conductors in response to each of said conductive means being flexed in a predetermined direction;

actuator means mechanically contacting said casing and slideably movable in first and second linear orthogonal directions into a plurality of at least three predetermined positions with respect thereto, said actuator means including a cam surface selectively coupled to said plurality of conductive means for selectively flexing a predetermined number of said conductive means in said predetermined direction in response to said actuator means being in each of said plurality of predetermined positions; and a plurality of cam following means each coupled between an associated one of said conductive pads and said cam surface, and mounted relatively fixed in a first and second orthogonal direction with respect to said pads by said casing, said cam following means being selectively forced by said cam surface against said associated pad in a third direction orthogonal to said first and second directions when said actuator means is moved.

19. The multiple position switch according to claim 18 wherein said cam surface has indentations and said plurality of cam following means have projections which are in contact with said cam surface.

20. A multiple position switch for selectively interconnecting a plurality of isolated conductors, including:

a casing:

positioning means attached to said casing for positioning components with respect thereto;

conductive means flexibly joined to said casing and located in relatively fixed predetermined positions with respect thereto by said positioning means mounting means coupled to said casing for positioning said conductive means normally adjacent to a plurality of isolated conductors for conductively contacting and electrically bridging pairs of said conductors in response to said conductive means adjacent to said pairs being flexed in a predetermined direction; and actuator means mechanically contacting said casing and slideably movable in both first and second linear orthogonal directions with respect to said casing into a plurality of at least three predetermined positions with respect thereto, said actuator means including a cam surface, integrally movable therewith, selectively coupled to said conductive means for selectively flexing said conductive means in said predetermined direction in response to said actuator means being in each of said plurality of predetermined positions to selectively bridge pairs of said conductors for each of said positions.

21. A multiple position switch for selectively interconnecting a plurality of isolated conductors, including:

an external casing including positioning means for positioning components with respect thereto;

pressure sensitive conductive elastomer means joined to said casing and located in predetermined positions with respect thereto by said positioning means;

mounting means coupled to said casing for positioning said elastomer means normally adjacent to a plurality of isolated conductors for conductively contacting and electrically bridging pairs of said conductors in response to said elastomer means adjacent to said pairs being compressed in a predetermined direction; and actuator means mechanically contacting said casing and slideably movable in both first and second linear orthogonal directions with respect to said casing into a plurality of at least three predetermined positions with respect thereto, said actuator means including a cam surface, integrally movable therewith, selectively coupled to said elastomer means for selectively compressing said elastomer means in said predetermined direction in response to said actuator means being in each of said plurality of predetermined positions to selectively bridge pairs of said conductors for each of said positions.

* * * * *